United States Patent [19]

Guido et al.

[11] 4,316,425

[45] Feb. 23, 1982

[54] LIFTING KEEL FOR SPORTING SAIL BOATS

[76] Inventors: Jurgen Guido, Borsigstrasse 4; Norbert Binzer, Ingenieur Rontgen-Str. 54, both of D-8402 Neutraubling, Fed. Rep. of Germany

[21] Appl. No.: 63,122

[22] Filed: Aug. 3, 1979

[30] Foreign Application Priority Data

Aug. 10, 1978 [DE] Fed. Rep. of Germany ..... 2835085

[51] Int. Cl.[3] ..... B63B 41/00

[52] U.S. Cl. ..... 114/141; 114/138

[58] Field of Search ..... 114/140, 141, 142, 143, 114/138, 139, 126, 162; 403/381, 383; 211/162

[56] References Cited

U.S. PATENT DOCUMENTS 2,392,165 1/1946 Livingston ..... 114/162

FOREIGN PATENT DOCUMENTS 2743356 4/1979 Fed. Rep. of Germany ..... 403/381

2148864 3/1973 France ..... 114/141

*Primary Examiner*—Sherman D. Basinger

*Attorney, Agent, or Firm*—Squire, Sanders & Dempsey

[57] ABSTRACT

A lifting keel assembly for sailboats having a shaft obliquely inclined in forward and upward directions slidably receiving the lifting keel, the upper area of the lifting keel being provided with sliding shoes on the forward and rearward longitudinal edges, which sliding shoes are guided in associated prismatic guides of the shaft, one sliding shoe having on either side a protruding V-profile, and the associated guide enclosing said two V-profiles of the sliding shoe, while a further sliding shoe on the other edge of the keel is guided in an associated guide by two oppositely arranged sliding surfaces.

22 Claims, 6 Drawing Figures

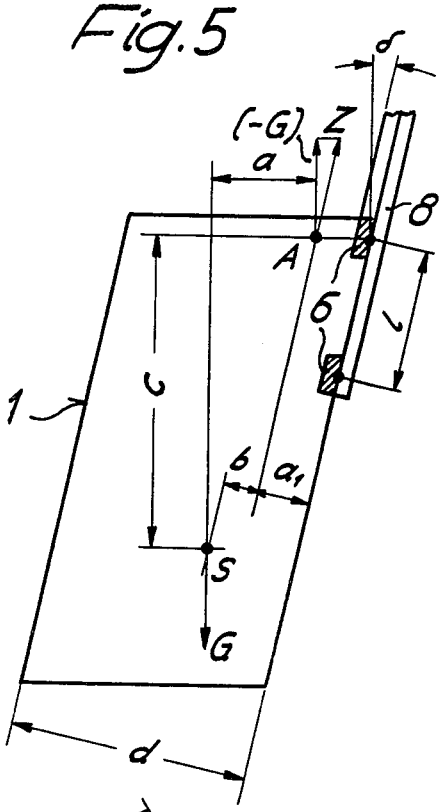
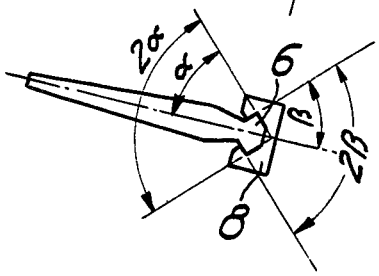
Fig.6
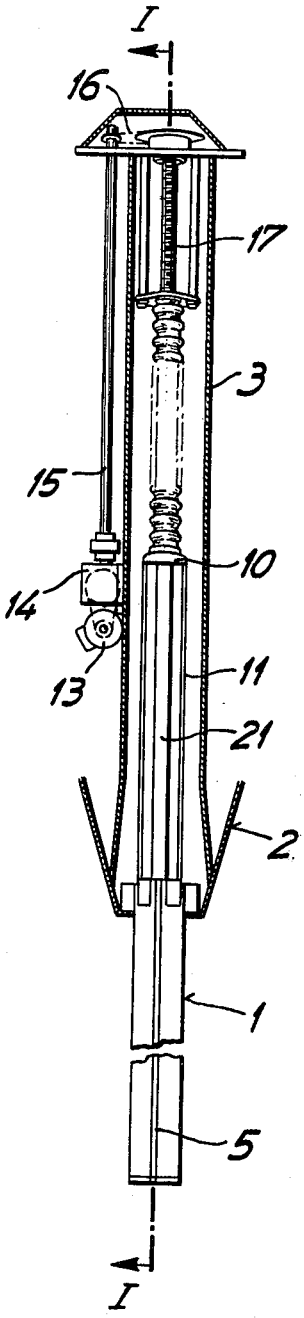
Fig.2

LIFTING KEEL FOR SPORTING SAIL BOATS

The present invention relates to a lifting keel for sporting sailboats. More specifically, the present invention relates to a lifting keel of the type which is slidably received within an inclined shaft and guided therein by associated sliding shoes and cooperative prismatic guides.

Lifting keels of which the ballast weight, as a rule, amounts to several tons, meet with considerable difficulties with regard to maintaining a reliable mobile guidage as well as a secure and play-free holding of the keel in the assigned shaft. Apart from the fact that the lifting keel extending vertically downward or, for hydrodynamic reasons, obliquely downward in driving direction, in the constructions heretofore known, such as disclosed for instance in French Pat. No. 2,148,864 which utilizes a type of sliding shoe, is continuously subject to canting stress between its front and rear guides, the inevitable lateral swaying movements of the sailboat during anchoring times in the harbour or during operation result in continuous corresponding lateral tilting stresses of the lifting keel in the guides thereof. Since, due to the shiftability of the lifting keel, a certain play between the sliding shoes of the keel and the guides contained in the shaft of the boat, as disclosed in the aforementioned French patent, cannot be dispensed with, the continuous alternating stresses result in correspondingly strong abrasive forces and disturbing noises which, in turn, result in an increased play and, hence, in an intensification of the original drawbacks.

In the lifting keel guidage disclosed in the aforementioned French patent it was endeavoured to eliminate the aforementioned difficulties by providing along the two longitudinal edges of the lifting keel in the shaft guide means with associated sliding shoes guided along and on either side of the outer edge thereof extending in front of the adjacent longitudinal edge of the lifting keel in such manner that each sliding shoe, towards each of the three associated guide surfaces of its guidage, is provided with independent sliding members, the two lateral ones of said sliding members being variable as to their mutual spacing to arrive at a desired play adjustment relative to the guide means. To ensure a continuous plane contact of the guide members with the assigned guide surfaces, said guide members, in addition, are mounted on the lifting keel so as to be tiltable to a certain extent. In spite of this very expensive and complicated construction, a certain lateral play of the sliding shoes within the guide means cannot be avoided, which play, as before, due to the operational lateral swaying movements of the sailboat results in corresponding alternating relative tipping movements between the guide means and the lifting keel and, hence, in non-negligible abrasive stresses and disturbing noises, which can be compensated only by a repeated subsequent adjustment of the play of the mentioned lateral sliding members in the lateral guides or by clamping devices calling for a very complicated and expensive construction. Since, beyond that, it is very difficult to so precisely predetermine the mutual distance of the two guides of the lifting keel that canting effects of the lifting keel guided therein and respective abrasive stresses are substantially precluded, it is necessary for the sliding members of the oppositely arranged sliding shoes, which are located immediately in front of the two longitudinal edges of the lifting keel, to be likewise adjustable as to their mutual distance. Hence, the construction in question is extraordinarily complicated and expensive and, beyond that, calls for regular attendance and subsequent adjustment, lest the continuous operational stresses in the guide means should result in respective play increases and, consequently, in increased abrasive stresses, after all.

It is an object of the present invention to improve upon the design of known lifting keel structures, such as those disclosed in French Pat. No. 2,148,864, and to provide a simpler guidage of the lifting of a keel, which is less susceptible to wear as regards the operational stresses and, hence, has a longer lifetime in continuous operation and is substantially completely maintenance-free.

According to the present invention, this objective is achieved by providing one sliding shoe on either edge of the keel for guiding the same within the shaft; wherein one sliding shoe is provided on either side thereof with a protruding V-shape profile and a mating prismatic guide, while the other sliding shoe is guided in an associated guide only by two oppositely arranged sliding surfaces.

The present invention permits one to refrain from a precise mutual adjustment of the two guide means over the entire width of the keel, because the canting forces arising from the ballast weight of the obliquely or vertically guided keel are already received by a lateral guide between closely juxtapositioned opposing guide surfaces. In contradistinction to the guide means heretofore known, the present invention can be spoken of as a "narrow guidage" along the entire width of the keel. Moreover, the present invention's positive guidage of the associated sliding shoe (depending on the selected position of the suspension point of the lifting keel relative to its center of gravity in the corresponding inner double V-profile of said guide) results in the sliding shoe, due to the canting force acting on it, always being more or less tightly pressed into the one V-shaped guide surfaces above and into the oppositely arranged V-shaped surfaces of the guide means below. Thus, the lifting keel is guided in the guide means completely free of play, not only within its own plane, but equally in transverse direction. The guide means disposed along the other longitudinal edge serves the only purpose of preventing lateral swinging out of the keel relative to the forces of water flow acting upon the same. Since the one ruling guide is completely free of any play of the lifting keel, no phenomena of abrasion arising from the operational swaying stresses need be feared. Finally, both the sliding shoe with its two projecting V-profiles and the assigned prismatic guide with the respective inner double V-profile can be comparatively simple and yet accurately produced, without the necessity even of adhering to particularly narrow tolerances, because the V-guides in combination with the considerable canting forces of the heavy lifting keel acting on said guide permit a reliable and play-free guidage both in longitudinal and in transverse direction of the sailboat.

Further embodiments of the present invention relating in particular to a preferred coordination of the suspension point of the lifting keel with the center of gravity thereof, by which the unfavorable canting effects of the lifting keel on any simultaneous lifting movements thereof can be substantially reduced, are described herein.

In the drawing the invention is illustrated by way of example, as follows:

FIG. 2 shows a partial longitudinal section of the lifting keel according to line II—II of FIG. 1;

Figure 1:
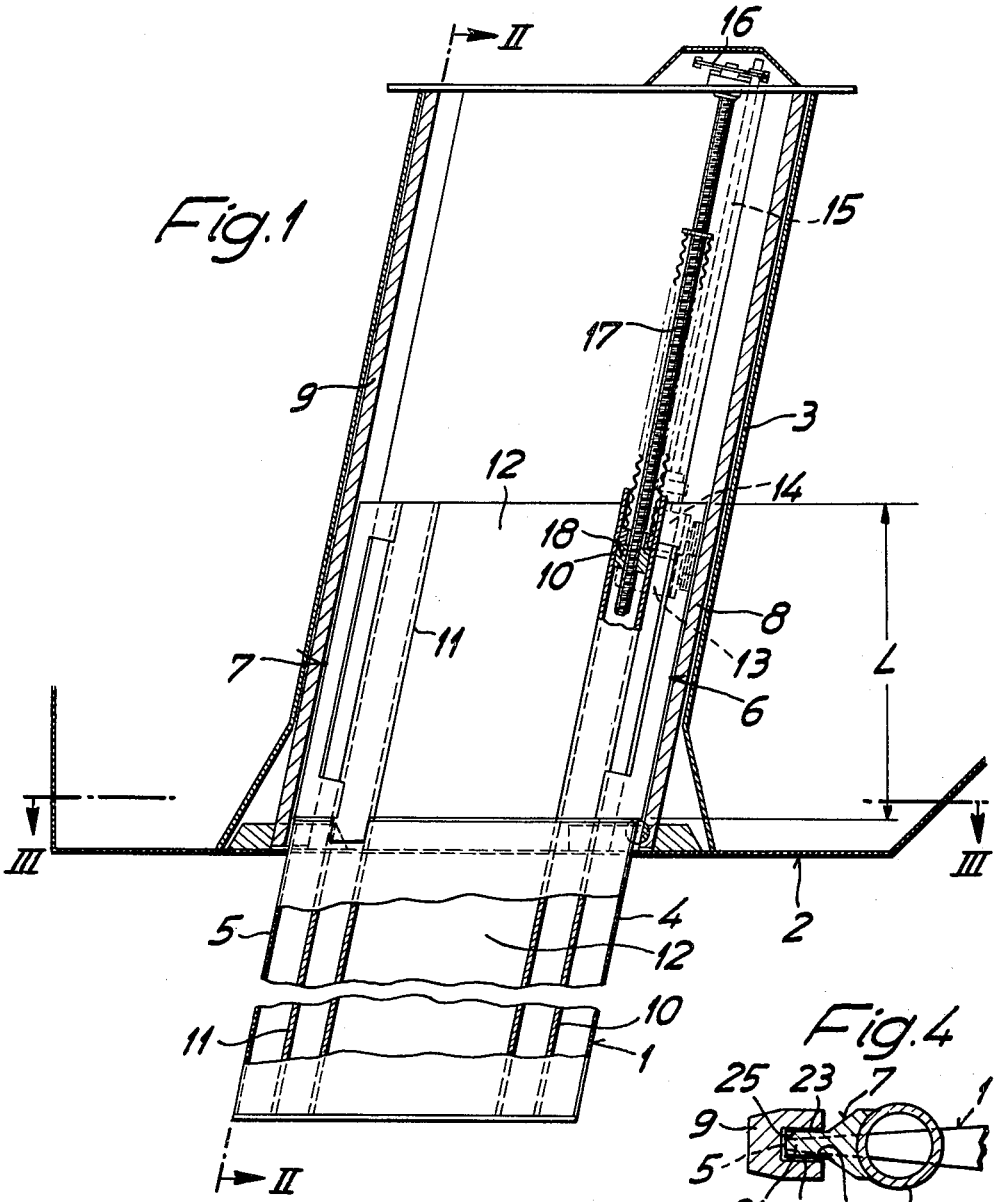
FIG. 1 shows a lifting keel guided in the shaft of an associated sailboat in a partial longitudinal section showing at the same time portions of the shaft according to line I—I of FIG. 2.
Figure 4:
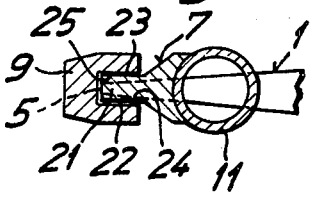
Figure 3:
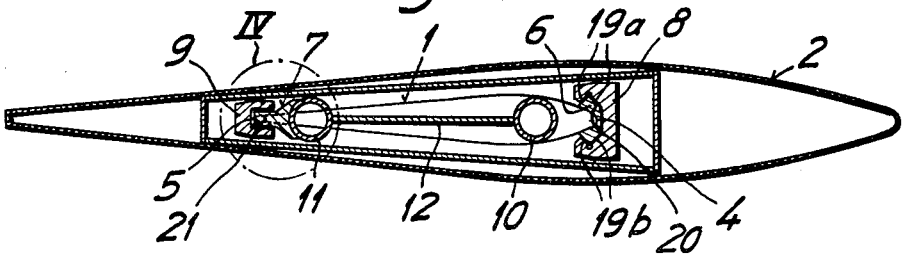

FIG. 3 exhibits a cross-section of the lifting keel according to line III—III of FIG. 1;

FIG. 4 shows an enlarged partial section IV of FIG. 3; and

FIGS. 5 and 6 show schematic representations according to FIGS. 1 and 3, from which constructional details of the lifting keel suspension and of the sliding shoe with associated prismatic guide can be seen.

Referring now to the drawings:

A sailboat 2, of which only the portion of the lifting keel 1 is represented, has a shaft 3 obliquely inclined in forward and upward direction, slidably receiving the lifting keel 1.

For guiding the lifting keel 1 in the shaft 3 the upper area of the lifting keel 1 is provided with sliding shoe 6 on the forward longitudinal edge 4 and sliding shoe 7 on the rearward longitudinal edge 5, which sliding shoes are guided in associated prismatic guides 8 and 9, respectively, of the shaft 3.

The lifting keel 1 has a profile approximately drop-shaped in cross-section and is reinforced both by a forward and a rearward tubular strut 10 and 11, respectively, and by an intermediate wall 12 connecting the same. The forward tubular strut 10 is with its full cross-section completely accommodated in the profile of the lifting keel 1. Some of the cross-section of the upper portion of the rearward tubular strut 11 extends beyond the profile of the keel 1, but the bottom portion of the rearward strut 11 consists only of that amount of cross-section which can be contained within the profile of the keel. Thus, when the keel 1 is extended fully downwards, only the profile of the keel extends beyond the sailboat. The profile cavity of the lifting keel 1, in a way not shown, is filled with an adequate ballast by which the lifting keel arrives at a total weight of several tons.

The lifting keel 1 is suspended via a suspension point from a lifting means. The figures show a lifting means using an electromotor 13 by which, via a gearing 14, a shaft 15 and a connecting drive 16, drives a screw spindle 17 in shaft 3 and extending into tubular strut 10. The lower end of the screw spindle 17 is attached to the keel at the suspension point by a nut 18 secured in the tubular strut 10, so that the keel 1 is raised or lowered by rotorary movement of screw spindle 17.

As can best be seen in FIG. 3, the forward sliding shoe 6 is provided on either side with a projecting V-profile 19*a* and 19*b*, while the associated front guide 8 positively encloses the two V-profiles 19*a* and 19*b* with a inner double V-profile 20.

As can best be seen in FIG. 6, the protruding V-profiles on sliding shoe 6 produces nose angles $2\alpha$, $2\beta$ which are oppositely arranged and pointing along the axis of motion of the sailboat. In other words, the plane of each half of each V-profile on sliding shoe 6 makes an acute angle ($\alpha$ for the forward half of each V-profile and $\beta$ for the rearward half of each V-profile) with the longitudinal median plane of the keel. The nose angles $2\alpha$, $2\beta$ are each smaller than 126° but not smaller than 60°. In other words, each acute angle $\alpha$, $\beta$ is less than 63°, but not smaller than 30°.

Both the sliding shoe 6 and the guide 8 are machined to permit displacement subject to low friction. In order to improve the sliding properties of the sliding shoe 6, the latter is provided with an antifriction coating. The rearward sliding shoe 7 is secured to the upper portion of the keel 1 (which still has the full round profile of the rearward tubular strut 11 so that some of the rearward tubular strut extends beyond the profile of the keel) with a fin-like member 21 formed along the outer end of the shoe 7 and pointing to the rearward longitudinal edge 5 of the lifting keel 1. The fin-like member 21 has sliding surfaces 22 and 23 extending on either side in parallel to each other which guide the rearward shoe 7 between conforming oppositely arranged inner sliding surfaces 24 and 25 of the rearward prismatic guide 9. Here, too, sufficient play may be provided between the mentioned sliding surfaces, as the lifting keel 1 need only be guided against lateral swinging movements, and not necessarily against tilting forces.

FIG. 5 illustrates the relationship between the suspension point A and several other characteristics of the keel. The suspension point A is located within the median plane of the keel approximately in the horizontal plane of the upper end of the sliding shoe 6 and between the shoe and the center of gravity S. The angle of inclination $\delta$ of the lifting keel 1 amounts to approximately 11° and the horizontal distance a between the center of gravity S and the suspension point A of the lifting keel 1 amounts to somewhat more than onesixth of the width d of the keel plus the vertical distance c between the center of gravity S and suspension point A multiplied by the tangent of the angle of inclination $\delta$. Moreover, the aforementioned distance c amounts to about 1.2 times the width d of the keel. Besides, the length l (in the longitudinal direction of the lifting keel 1) of the one sliding shoe 6 amounts to about 1.4 times the horizontal distance a between the center of gravity S and the suspension point A and, simultaneously, four times the lateral distance b of the suspension point A from the center of gravity S.

The lifting keel 1 lowered in the manner as shown in FIGS. 1 and 2, due to the aforementioned ballast weight, can describe a canting movement (according to FIG. 1, counterclockwise) only a distance sufficient for its forward sliding shoe 6 to contact the rearward guide surfaces of the inner double V-profile 20 of the guide 8 above and the forward guide surfaces of the inner double V-profile 20 of the guide 8 below. In consequence of the design of the profiles of the guide and shoe, such support results in a play-free securement of the lifting keel 1 within the longitudinal median plane of the shaft 3 and, hence, also of the sailboat 2. Without that profile design the transverse forces conditioned by the rolling and swaying movements of the sailboat 2 and also transverse of the lifting keel 1, could interfere with the aforementioned play-free abutment of the sliding shoe 6 against the inner double V-profile 20. By the strength of the invariably excessive canting moment effective counterclockwise within the plane of the keel the play-free position once assumed by the sliding shoe 6 in the prismatic guide 8 is continuously maintained, so that also during long-term operation symptoms of wear need not be feared either on the forward or on the rearward guide of the lifting keel 1.

Notwithstanding this fact, the lifting keel 1 can be shifted in the prismatic guides 8 and 9 by the electromotor 13 without particular frictional resistance, since the lifting power Z acting on the suspension point A of the lifting keel 1 must at any rate be greater than its weight G and also because the frictional force, which during lifting arises from the canting movement in the guide 8, reduces the canting moment due to its distance $a_1$ from the suspension point A.

Instead of the electromotor 13, a hydraulic drive or any other suitable drive may be used for lifting and lowering the lifting keel 1. In order to substantially neutralize the tilting moment acting on the forward prismatic guide 8 during lifting of an extended keel 1, the forward tubular strut 10 can also be placed further backward so that it comes to lie in the central profile area of the keel 1. Alternately, the screw spindle 17 may be guided in a separate tubular strut arranged in the central profile area of the keel.

The constructional details of the suspension and of the guide of the lifting keel 1 may also differ from the described exemplified embodiment in various respects and still be within the scope of the invention. It will, for instance, be sufficient for the horizontal distance a between the center of gravity S and the suspension point A of the lifting keel 1 to amount to about one-third to one-sixth of the width d of the keel plus the vertical distance c between the center of gravity S and the suspension point A multiplied by the tangent of the angle of inclination δ of the lifting keel 1. Instead of 1.3 times the width d of the keel, the aforementioned vertical distance c may also amount up to three times the width d of the keel. Furthermore, the length l of the one sliding shoe 6 may also be less than 1.4 times the amount of the horizontal distance a between the center of gravity S and the suspension point A of the lifting keel 1, but not less than equal to the horizontal distance a. Since play-free guidage of the lifting keel 1 in the forward prismatic guide 8, is insured by at least some torque about an axis extending transversely to the lifting keel 1, the suspension point A of the lifting keel 1 may also be provided within the median plane of the keel, in plan view laterally of its center of gravity.

While we have described our invention in connection with preferred embodiments thereof, it is to be understood that numerous and extensive changes may be made therein without however departing from the spirit of the claimed invention.

What is claimed is:

1. A lifting keel assembly for a sailboat, comprising:

a keel having forward and rearward longitudinal edges;

a shaft for receiving said keel within the sailboat;

a first sliding shoe on the upper portion of one of said longitudinal edges of said keel, said first shoe having two sides with protruding V-profiles;

a second sliding shoe on the upper portion of the other of said longitudinal edges of said keel;

a first prismatic guide along the interior of said shaft, said first guide having opposing guide surfaces in an inner double V-profile corresponding to the protruding V-profiles of said first sliding shoe, said guide surfaces enclosing and limiting forward, backward and sideways movement of said first shoe; and, a second prismatic guide along the interior of said shaft, said second shoe being received between two opposing surfaces on said second guide.

2. The invention of claim 1, wherein said shaft is obliquely inclined toward the bow of the sailboat, said first shoe is along said forward longitudinal edge of said keel, and said first guide is along the forward interior of said shaft.

3. A lifting keel assembly for a sailboat, comprising:

a keel having forward and rearward longitudinal edges;

a shaft for receiving said keel within the sailboat;

a lifting means for lifting said keel into said shaft;

a first sliding shoe on the upper portion of one of said longitudinal edges of said keel, said first shoe having two sides with protruding V-profiles;

a second sliding shoe on the upper portion of the other of said longitudinal edges of said keel, said second sliding shoe having two oppositely arranged sliding surfaces;

a first prismatic guide along the interior of said shaft, said first guide having opposing guide surfaces in an inner double V-profile corresponding to the protruding V-profiles of said first sliding shoe, said guide surfaces enclosing and limiting forward, backward and sideways movement of said first shoe; and, a second prismatic guide along the interior of said shaft, said second shoe being received between two opposing plane sliding surfaces on said second guide.

4. The invention of claim 3, wherein said keel is suspended from said lifting means at a suspension point which is located between said first sliding shoe and the center of gravity of said keel.

5. The invention of claim 4, wherein said first sliding shoe is on said forward longitudinal edge of said keel and said first guide is along the forward interior of said shaft.

6. The invention of claims 4 or 5, wherein the length (l) of said first shoe is approximately four times the lateral distance (b) between said suspension point and said center of gravity of said keel; wherein said keel is inclined in the forward direction by an oblique angle of inclination (δ) with the vertical; and, wherein the horizontal distance (a) between said suspension point and said center of gravity is approximately from one-third to one-sixth of the lateral width (d) of said keel plus the vertical distance (c) between said suspension point and said center of gravity multiplied by the tangent of said angle of inclination (δ).

7. The invention of claim 6, wherein said length (l) of said first shoe is approximately from 1 to 1.4 times said horizontal distance (a) between said center of gravity and said suspension point.

8. The invention of claim 7, wherein said suspension point is located approximately in the horizontal plane of the upper end of said first shoe and wherein said vertical distance (c) between said center of gravity and said suspension point is approximately from 1.3 to 3 times said lateral width (d) of the keel.

9. The invention of claim 8, wherein said second shoe is secured to a longitudinal tubular strut through said keel.

10. The invention of claim 8, wherein the plane of each half of each said V-profile of said first shoe makes an acute angel (α, β) of less than 63° and no smaller than 30° with the longitudinal median plane of said keel.

11. The invention of claim 10, wherein said second shoe is secured to a longitudinal tubular strut through said keel.

12. The invention of claim 7, wherein the plane of each half of each said V-profile of said first shoe makes an acute angle (α, β) of less than 63° and no smaller than 30° with the longitudinal median plane of said keel.

13. The invention of claim 12, wherein said second shoe is secured to a longitudinal tubular strut through said keel.

14. The invention of claim 7, wherein said second shoe is secured to a longitudinal tubular strut through said keel.

15. The invention of claim 6, wherein said suspension point is located approximately in the horizontal plane of the upper end of said first shoe and wherein said vertical distance (c) between said center of gravity and said suspension point is approximately from 1.3 to 3 times said lateral width (d) of the keel.

16. The invention of claim 15, wherein the plane of each half of each said V-profile of said first shoe makes an acute angle ($\alpha$, $\beta$) of less than 63° and no smaller than 30° with the longitudinal median plane of said keel.

17. The invention of claim 16, wherein said second shoe is secured to a longitudinal tubular strut through said keel.

18. The invention of claim 15, wherein said second shoe is secured to a longitudinal tubular strut through said keel.

19. The invention of claim 6, wherein the plane of each half of each said V-profile of said first shoe makes an acute angle ($\alpha$, $\beta$) of less than 63° and no smaller than 30° with the longitudinal median plane of said keel.

20. The invention of claim 19, wherein said second shoe is secured to a longitudinal tubular strut through said keel.

21. The invention of claim 6, wherein said second shoe is secured to a longitudinal tubular strut through said keel.

22. The invention of claim 3, wherein said first sliding shoe is on said forward longitudinal edge of said keel and said first guide is along the forward interior of said shaft.

* * * * *